US005398798A

United States Patent [19]

Ericson

[11] Patent Number: 5,398,798

[45] Date of Patent: Mar. 21, 1995

[54] ELECTRONIC CIRCUIT PROTECTION AUTOMATIC POWER INTERRUPT

[76] Inventor: Earl J. Ericson, 105 Parkwood Dr., Broken Arrow, Okla. 74012

[21] Appl. No.: 2,746

[22] Filed: Jan. 11, 1993

[51] Int. Cl.[6] ..... G07F 9/02

[52] U.S. Cl. ..... 194/202; 340/825.35

[58] Field of Search ..... 194/200, 201, 202, 348; 340/825.35

[56] References Cited

FOREIGN PATENT DOCUMENTS 2611157 9/1977 Germany ..... 194/200

1-250189 10/1989 Japan ..... 194/348

*Primary Examiner*—F. J. Bartuska

*Attorney, Agent, or Firm*—Frank J. Catalano; Scott R. Zingerman

[57] ABSTRACT

A device for use with a machine, such as a vending machine, automatic teller machine, change machine, cash register, game machine, personal or business machine or the like, having a cabinet containing machine electrical circuits and a door and at least one possible point of entry through the cabinet and door by foreign substances into contact with the machine electrical circuits to cause their operation in violation of machine protocol, minimizes the damage caused by such protocol violations. The device interrupts the AC power to the machine electrical circuits in response to sensors disposed as close to the points of entry as possible. Thus, all machine circuits are shut down before damage can occur. At least one sensor proximate each of the points of entry detect the penetration of the foreign substances and initiate generation of an electrical control signal for operating the interrupt to disconnect the machine circuits from the AC power source. The control signal is generated continuously after detection of penetration of a foreign substance, even after the substance has cleared the sensor. An alarm is connected in series with a switch to the machine AC power source on the power side of the interrupt and the switch is normally open to deactivate the alarm and closes in response to the control signal to activate the alarm. A timing signal commences substantially simultaneously with the control signal and discontinues after a preselected time, discontinuance of the timing signal resulting in deactivation of the alarm after the selected period of time.

12 Claims, 3 Drawing Sheets

ELECTRONIC CIRCUIT PROTECTION AUTOMATIC POWER INTERRUPT

BACKGROUND OF THE INVENTION

This invention relates generally to protection of electronic circuits and more particularly concerns devices for preventing foreign conductive substances from passing over the electrical components of machines while power is connected to those components.

The annual cost of repairing damage to personal and business equipment such as typewriters, computers, copiers and the like resulting from spilled liquids, paper clips, staples, coins and other conductive materials contacting electronic components while they are operating is considerable. In addition, losses due to natural causes or vandalism impacting the electronic components of automatic teller machines, telephones, change machines, generators, motors and similar equipment are significant.

In one particular example, the salting of vending machines with any of a variety of conductive substances for the purpose of causing the internal electrical components of the machines to function without compliance with those protocols established for appropriate access is becoming an increasingly frequent and expensive problem. Salting not only results in the obvious losses from the avoidance of the protocol, but also in damage to the electrical components contacted by the substances with ensuing down time and repair losses and, at times, even in fire or safety hazards.

While known protection devices do reduce the losses incurred as the result of protocol avoidance, natural or otherwise, they do not terminate power to all of the internal components of the machine quickly enough to minimize equipment damage. The known devices do not detect the substance prior to contact with the machine circuitry and, therefore, the substance penetrates to at least some of the electrical components prior to detection. Location of protection devices at the point of entry of the foreign substance has heretofore been impractical because of the relative insensitivity of the substance sensors. For example, salting is often accomplished by infiltrating the point of entry with a saline solution. While sensors are generally sensitive enough to distinguish the presence of one drop of saline solution contacted, present anti-salting devices are unable to distinguish between a drop of saline solution and a drop of non-saline water. Consequently, such devices cannot be universally used. In outdoor conditions, an inconsequential drop of rainwater could trigger the sensors. Even in indoor conditions such as a pool area, a laundromat or any other water-accessible location, wet hands or splashing water could cause the mechanism to operate and unnecessarily shut down the machine.

It is therefore an object of this invention to provide a protection device which detects a foreign substance as close as possible to its point of entry into any of a variety of machines including, but not limited to, automatic teller machines, game machines, vending machines, office machines and the like. Another object of this invention is to provide a protection device usable with a wide variety of sensors so that different substances can be detected. It is also an object of this invention to provide a protection device in which multiple sensors may be used to monitor a multiplicity of entry points into the electrical equipment. Furthermore, it is an object of this invention to provide a protection device which initiates power interruption procedures upon detection of a foreign substance at a point of entry. Another object of this invention is to provide a protection device which generates a signal usable to initiate operation of one or more of a variety of circuits upon detection of a foreign substance at its point of entry. And it is an object of this invention to provide a protection device which will trigger an alarm upon infiltration by a foreign substance into a port of entry into the machine. In the event an alarm is incorporated in the device, it is further an object of this invention to provide a protection device in which a timer controls the activation and deactivation of the alarm.

SUMMARY OF THE INVENTION

Many vending machines, such as soft drink vending machines, have a cabinet and a door with the machine electrical circuits contained in the cabinet. An external AC power source is connected via an extension cord to a housing in the door of the machine. Male and female connectors mated between the door and the cabinet provide power to the machine circuits. Other types of machines do not have internal male and female connectors and, for the purposes of this invention, such connectors should be added to the existing equipment or the protection device spliced in the existing equipment. This description, directed to one preferred embodiment of the protection device for use with vending machines having such connectors, assumes the presence of the connectors.

Any given machine will have a variety of possible points of entry through the cabinet and/or door by foreign substances which, once in contact with the machine electrical circuits, will cause their operation in violation of the machines's protocol. In accordance with this invention, a device for minimizing losses due to penetration by foreign substances includes a DC power source, preferably deriving its energy from the AC source connected in the door. A sensor circuit including a multiplicity of sensors, preferably disposed in close proximity to the points of entry of foreign substances into the machine is user and/or factory adjustable to control its sensitivity level and to assure operation during incidents of vandalism such as salting without causing operation during natural conditions. A control circuit latches the device in operation once the salting condition has been sensed despite clearance of the salting condition. A switch responsive to the sensor signal or the latched control signal causes an interrupt to disconnect the power source from the machine circuits immediately upon penetration of a foreign substance into one of the points of entry and preferably also causes an alarm to operate, indicating the existence of a salting condition. A timer limits the duration of the alarm to a selected period of time after the occurrence of the salting.

In a preferred embodiment, an interrupt having male and female connections is interposed between the male and female connectors of the machine door and the machine cabinet. The interrupt is responsive to an overload and/or opening of the AC power source. A switch, preferably connected in parallel with the machine circuits and in a normally open condition, will short circuit the AC power source in the interrupt when it is closed. A DC power source derived from the AC power source feeds the sensor circuit which preferably consists of a first voltage divider between the DC power source and the negative input of a comparator, this first voltage divider including a plurality of sensors electrically connected in parallel to ground so that penetration of a foreign substance to any one of the sensors causes a significant reduction in the resistance of the voltage divider. The sensors are located as close as possible to the point of entry of the foreign substances into the door and/or cabinet so that penetration is detected at the earliest possible time. The second voltage divider connected between the DC power source and the positive input of the comparator has a variable resistance so that the point at which the comparator will generate a sensor signal is selectable. The output signal of the comparator triggers operation of the switching means to disconnect power to the machine circuits as soon as penetration of a foreign substance is detected at any of the points of entry into the machine. Preferably, the positive input of a control amplifier is connected to the comparator output and the negative input of the control amplifier is connected to the DC power source through another voltage divider so that the control amplifier provides an output signal whenever the comparator output exceeds the negative input to the control amplifier. A feedback resistor or diode connected between the control amplifier output and its positive input latches the amplifier so that the control signal will be continuously generated by the amplifier once the comparator generates an output signal even though the foreign substance causing operation of a sensor may have cleared. Preferably, this voltage divider will have a switch for manual interruption of the control amplifier operation if desired by the user. The device further preferably includes an alarm connected to the AC power source on the power side of the interrupt together with a normally open switch connected in series with the alarm. The switch is closed to activate the alarm in response to the existence of the control signal at the comparator. A transistor connecting the switch in series with the DC power source has its base connected to the output of the control amplifier so that the output signal of the control amplifier will cause the alarm switch to transfer to the closed condition and thus activate the alarm. The output of the control amplifier is also connected to a negative input of an integrator through a voltage divider and the positive input of the integrator is connected through another voltage divider to the DC power source. The integrator provides a ramping voltage which commences substantially simultaneously with the commencement of the control signal from the control amplifier. Another comparator having its negative input connected to the integrator output and its positive input connected to a variable voltage divider to the DC power source generates an output for a specific period of time established by the variable voltage divider. Thus, the alarm will automatically be disconnected after the selected period of time.

BRIEF DESCRIPTION OF THE DRAWINGS

Other objects and advantages of the invention will become apparent upon reading the following detailed description and upon reference to the drawings in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION

Figure 1:
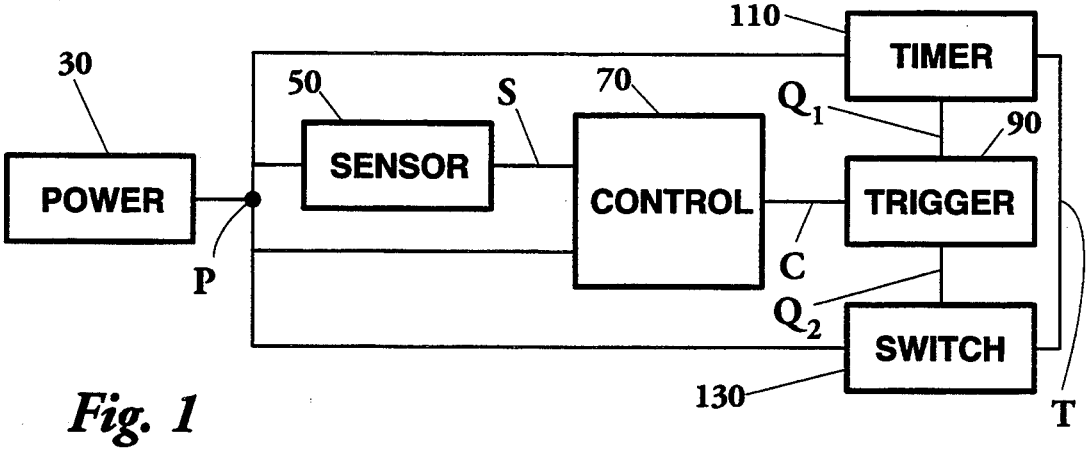
FIG. 1 is a block diagram of the DC components of a preferred embodiment of the protection device.

The DC components of a preferred embodiment of the protection device as used, for example, with a soft drink vending machine, are illustrated in FIG. 1 and include a power circuit 30 which supplies a positive DC voltage to a sensor circuit 50, a control circuit 70, a timer circuit 110 and a switch circuit 130. The sensor circuit 50 detects the infiltration of selected foreign substances at selected points of entry to the vending machine and communicates the occurrence of that event to the control circuit 70 which then delivers a control signal to a trigger circuit 90. The trigger circuit 90 in turn activates the timer 110 and the switch 130, the switch 130 interrupting power to the internal vending machine circuits and the timer 110 activating an alarm for the period of time established by the timer 110.

Figure 2:
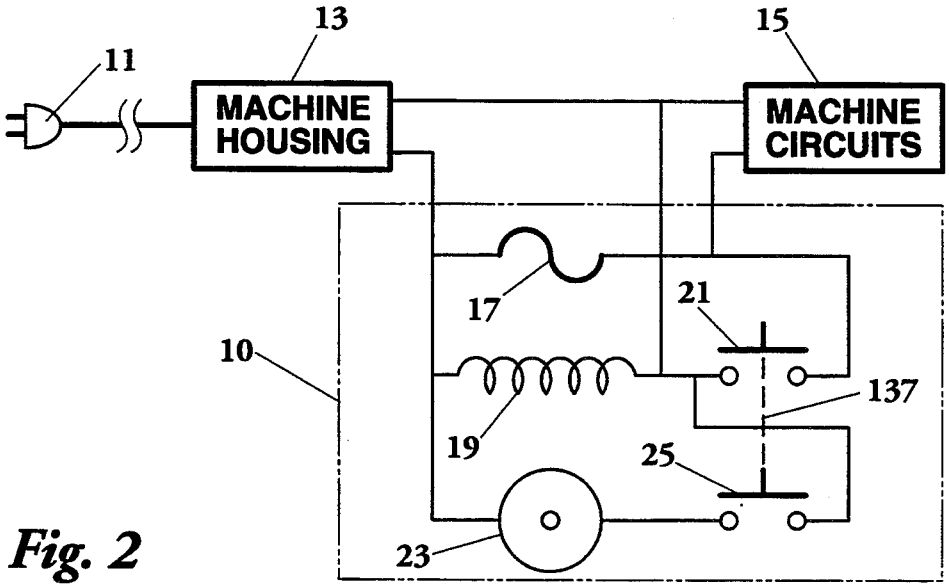
FIG. 2 is a partial schematic and partial block diagram illustrating the 120 Volt AC components of a preferred embodiment of the protection device connected in a typical vending machine environment.

FIG. 2 illustrates the 120 volt AC circuit 10 of the protection device connected in its environment in the vending machine. Typically, the vending machine will be connected to an external 120 volt AC source via a plug 11 having conductors extending into the vending machine housing 13, normally located in the door of the vending machine with a female plug on an interior portion of the door. The machine circuits 15 typical of any soft drink vending machine are generally mounted in the vending machine cabinet and extend to a male plug which mates with the female plug in the door to complete the circuits. Other types of machines may require additions of such connectors or a splice to incorporate the protection device into the machine. As shown, the 120 volt AC circuit of the protection device is inserted between the female and male plugs of the machine housing 13 and the machine circuits 15, respectively. The AC circuit 10 includes a fuse 17, or other suitable type of overload disconnect, inserted into one of the conductive paths between the machine housing 13 and the machine circuits 15. The high voltage coil 19 of a 120 volt AC transformer is connected between the conductors connecting the machine housing 13 and the machine circuits 15 on the power side of the fuse 17. Thus power is constantly supplied to the coil 19 regardless of the condition of the fuse 17. A normally open switch 21 is connected between the conductors connecting the machine housing 13 and the machine circuits 15 on the load side of the fuse 17. Thus, closing of the switch 21 will cause an overload on the fuse 17, interrupting all power to the machine circuits 15. Connected in parallel with the coil 19 is a horn 23 or other selected alarm mechanism or mechanisms in series with a second normally open switch 25. Thus, although the power is normally on, the horn 23 will be in a normally deactivated condition. The switches 21 and 25 may be of any known double-pole, single-throw type, so that the switch 25 closes simultaneously with the closing of the switch 21, connecting the horn 23 to the power supply on the power side of the fuse 17 so that the alarm will continue to be activated until such time as the switch 25 is reopened.

Figure 3:
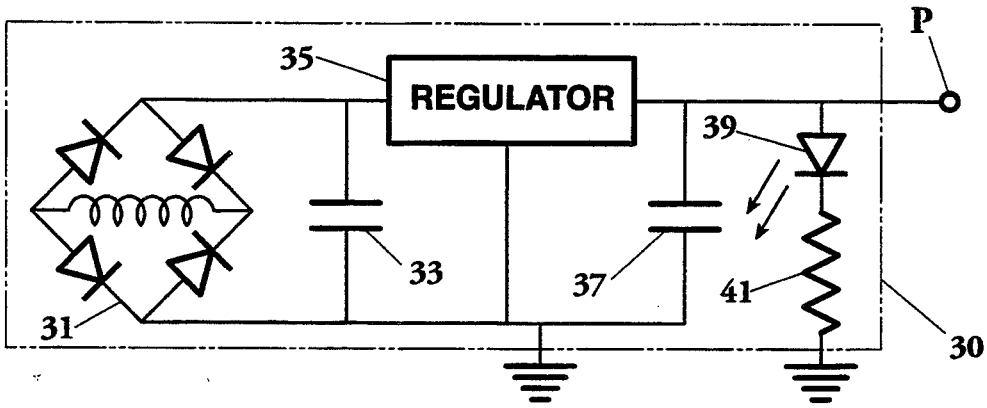
FIG. 3 is a schematic diagram of a typical power block of the protection device DC components illustrated in FIG. 1.

As shown in FIG. 3, DC power is provided by use of a single phase, full wave, bridge rectifier 31 including the low voltage coil of the transformer above discussed. The rectifier 31 is connected across a filter capacitor 33 which provides a relatively straight line DC voltage to a regulator 35, the output of which is further maintained at substantially constant voltage by the use of a second capacitor 37. Finally, a light emitting diode (LED) 39 connected to ground via a resistor 41 indicates when DC power is available at the output P of the power block 30. Any other suitable DC power circuit may be used to replace the power block 30.

Figure 4:
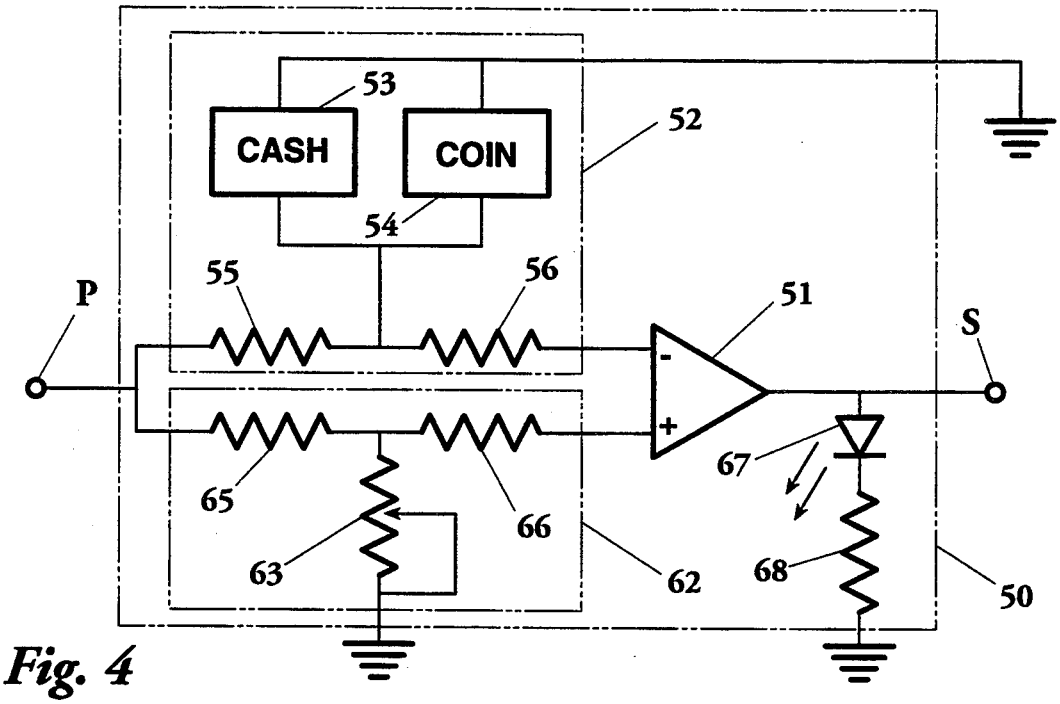
FIG. 4 is a schematic diagram of a preferred embodiment of the sensor block of the protection device DC components illustrated in FIG. 1.

Turning now to FIG. 4, a preferred embodiment of the sensor block 50 of the anti-salting device is shown in detail. The sensor block 50 consists essentially of an amplifier 51 comparing the voltage applied to its negative input via a first voltage divider 52 with a second voltage provided to its positive input via a second voltage divider 62, the voltage dividers 52 and 62 being connected to the output P of the power block 30. The voltage divider 52 consists of any number and type of foreign substance sensors connected in parallel. As shown, the sensors include a first sensor 53 disposed at a bill acceptor of a vending machine and a second sensor 54 connected at a coin acceptor of a vending machine. The sensors 53 and 54 may be, for example, electrically conductive strips or contacts spaced approximately $\frac{1}{8}''$ apart. The parallel connected sensors 53 and 54 are in turn connected between ground and a pair of series connected resistors 55 and 56 between the output P of the power block 30 and the negative input of the comparator 51. In the embodiment shown, the resistor 55 is selected so that the voltage at the negative input to the comparator 51 will normally be approximately equal to the supply voltage P. The resistor 56 isolates the voltage divider 52 from the amplifier 51. When any of the sensors 53 or 54 is infiltrated by a foreign substance to be detected, the first voltage divider 52 drops the negative input of the comparator 51 lower than the positive input. The second voltage divider 62 consists of a potentiometer 63 connected at one end to ground and at its other end between a pair of resistors 65 and 66 which are series connected between the output P of the power block 30 and the positive input of the comparator 51. The resistors 65 and 66 connected to the positive input of the comparator 51. The resistor 65 is selected so as to maintain the positive input at a voltage less than the negative input so that the output of the comparator 51 is normally low. However, when the first voltage divider 52 drops by infiltration of the sensors 53 or 54, the voltage at the negative input of comparator 51 drops below that of the positive input, driving the output voltage S of the comparator 51 high. The potentiometer 63 is set to fine tune the sensor circuit 50 to determine the point at which the sensors 53 or 54 will cause the comparator 51 to switch from the low to the high condition. To accomplish this, a light emitting diode (LED) 67 is connected from the output S of the comparator 51 through a resistor 68 to ground. The sensors 53 or 54 are placed in an appropriate foreign substance, such as rain or tap water, and the potentiometer 63 adjusted to the level at which the light emitting diode (LED) 67 turns off. The potentiometer 63 is then backed off so that the light emitting diode (LED) 67 is not energized whether or not the sensors 53 or 54 are in the water. At this point, application of the selected offending substance, such as saline water, is made to the sensors 53 or 54 and the light emitting diode (LED) 67 will light. The potentiometer 63 is then further backed off, approximately two or three turns, until the light emitting diode (LED) 67 goes out. The potentiometer 63 is then turned up approximately one-half the number of turns that it had been backed off. The sensor circuit 50 will now produce an output voltage S only if the sensors 53 or 54 are infiltrated by the selected offensive substance, in this case saline water and not rain or tap water.

Figure 5:
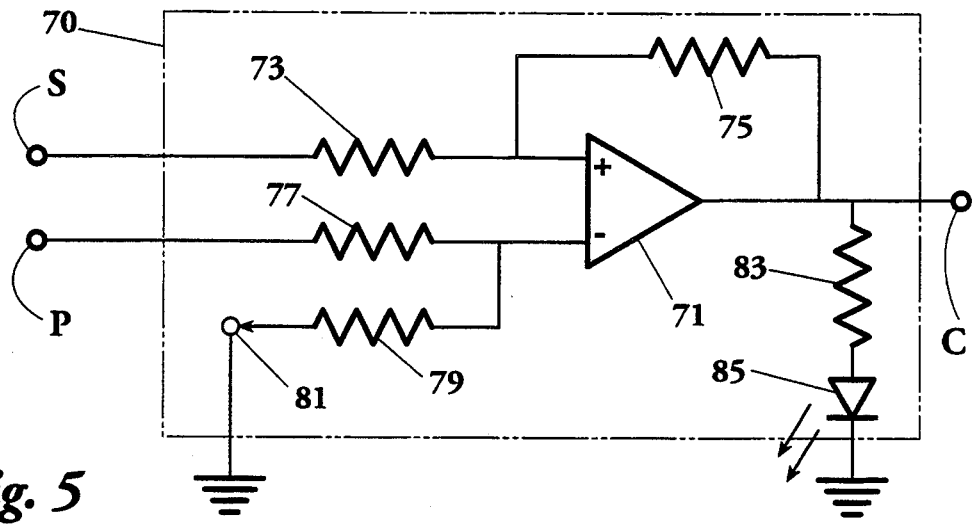
FIG. 5 is a schematic diagram of a typical control block of the protection device DC components of FIG. 1.

Looking now at FIG. 5, the output voltage S of the sensor block 50 is applied to the positive input of an amplifier 71 through a resistor 73. A feedback resistor 75 is connected between the output and positive input of the amplifier 71 for reasons hereinafter explained. The negative input of the amplifier 71 is connected through a voltage divider consisting of a first resistor 77 connected to the output P of the power block 30 and a second resistor 79 connected through a reset switch 81 to ground. The positive input of the amplifier 71 will be normally low in conformance with the output S of the sensor block 50. The negative input of the amplifier 71 will be normally set at approximately one fourth of the power supply voltage P by the voltage divider resistors 77 and 79. When the output voltage S of the sensor block 50 goes high, the output C of the control block amplifier 71 will also go high. However, when the detected substance clears the sensors 53 and 54 of the sensor block 50, the output voltage S of the sensor comparator 51 again goes low. This would ordinarily cause the output C of the control block amplifier 71 to go low, but the feedback resistor 75 causes the voltage at the positive input of the amplifier 71 to remain higher than the voltage of the negative input to the amplifier 71, thus latching the amplifier 71 high and maintaining the output voltage C of the control block 70. If it is desired to terminate the control voltage C at the output of the amplifier 71, the reset switch 81 is opened, shutting off the amplifier 71 and stopping the control signal C. The same result would of course be achieved by disconnecting the power to that vending machine. The output C of the amplifier 71 is connected to ground through a resistor 83 and a light emitting diode (LED) 85 which will indicate when the control block amplifier 71 is conducting. It should be noted that, if desired, the feedback resistor 75 and even the control block 70 could be eliminated by adding a feedback hysteresis loop or diode to comparator amplifiers 51 of the sensor block 50.

Figure 6:
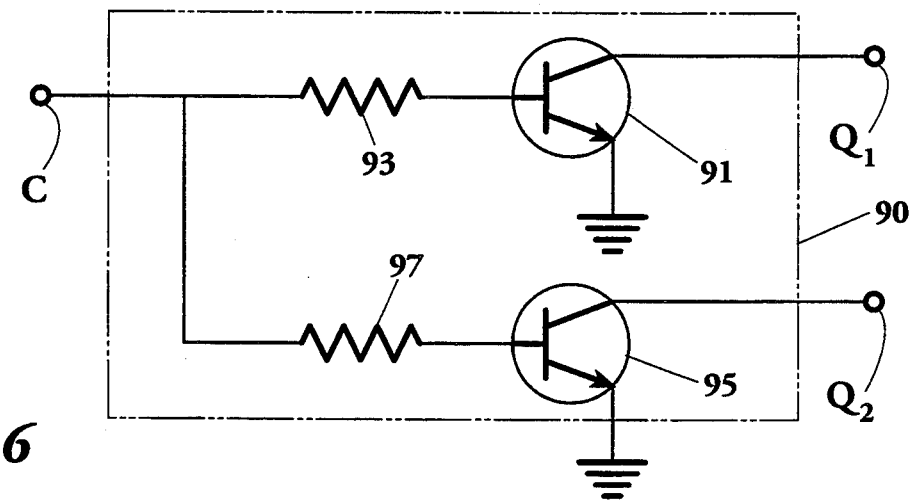
FIG. 6 is a schematic diagram of a typical trigger block of the protection device DC components of FIG. 1.

The trigger block 90 of the anti-salting device is illustrated in FIG. 6 and, in this typical arrangement, includes a first transistor 91 having its base connected to the control block output C through a resistor 93 and a second transistor 95 having its base connected to the control block output C via a second resistor 97. A first contact point Q1 is grounded when the control voltage C is applied through the resistor 93 to the base of the transistor 91 connecting its collector to its grounded emitter. A second contact point Q2 is similarly grounded by the second transistor 95.

Figure 7:
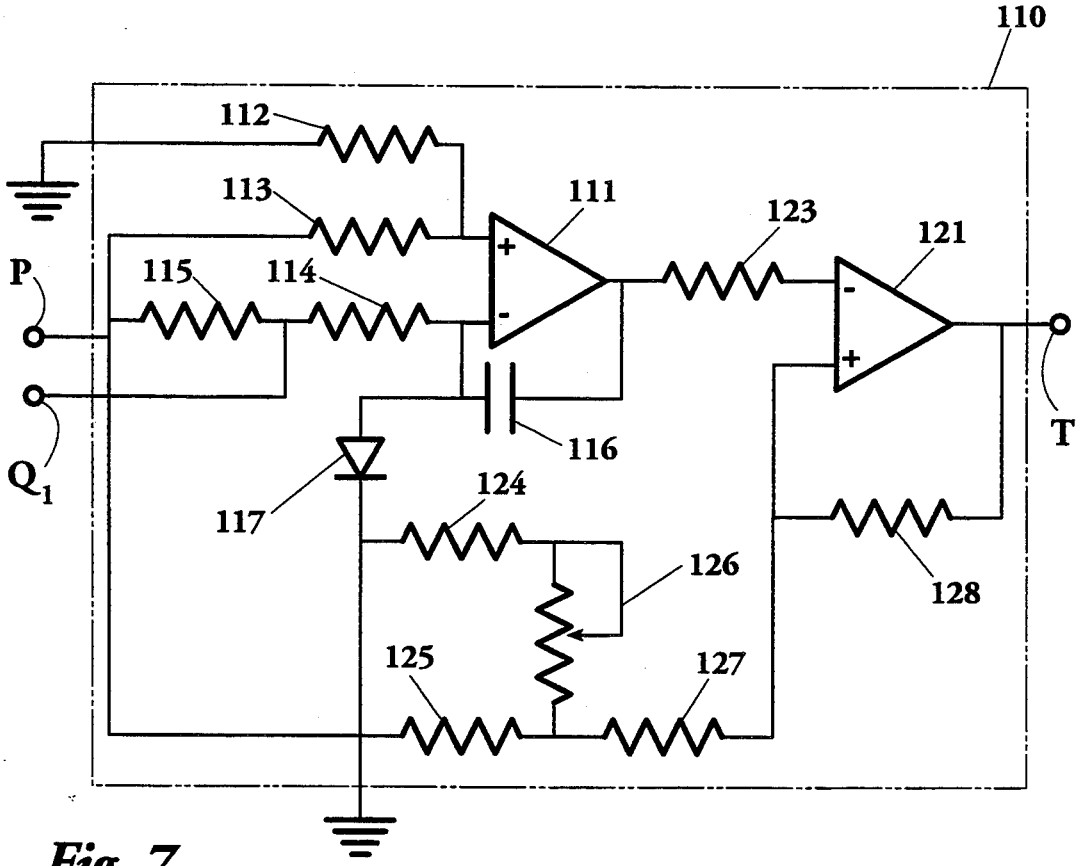
FIG. 7 is a schematic diagram of a preferred embodiment of the timer block of the protection device DC components of FIG. 1.

Looking now at FIG. 7, the first contact point Q1 of the trigger block 90 is applied to the timer block 110. The timer block 110 includes an integrating amplifier 111 having its positive input connected to ground via a resistor 112 and to the output P of the power source 30 via a resistor 113. The resistors 112 and 113 are selected to provide a constant input of approximately 0.1 volts at the positive input of the integrator 111. The negative input of the integrating amplifier 111 is connected to the output P of the power block 30 through series connected resistors 114 and 115 with the first contact point Q1 of the trigger block 90 being connected between these resistors 114 and 115. The resistor 114, in respect to the positive input, interposes a high to the negative input to the integrating amplifier 111 so that the output of the integrating amplifier 111 is normally low. When the first contact point Q1 of the trigger block 90 is grounded by the application of the control signal C to the base of the first transistor 91, the negative input to the integrating amplifier 111 goes low and output of the integrating amplifier 111 ramps from approximately zero to thirteen volts in accordance with the time constant established by a feedback capacitor 116 connected between the output of the integrating amplifier 111 and its negative input. In the preferred embodiment shown, the integrating amplifier 111 will take approximately eighty minutes to ramp high. In other applications, the ramping time may range from 30 to 180 minutes. A diode 117 connected between the negative input to the integrating capacitor and ground stabilizes the operation of the amplifier 111, keeping the high at the negative input at approximately 0.6 to 0.7 volts, the capacitor 116 discharging through the diode 117 when the negative input of the integrating amplifier 111 goes low. In the preferred embodiment shown, the capacitor 116 will take approximately one and one-half to two minutes to discharge. When the negative input of the amplifier 111 returns to its normally high state, the output of the integrating amplifier 111 returns to its normally low state. This output is connected to the negative input of a comparator amplifier 121 through a resistor 123 causing its output T to be normally high. Resistors 124 and 125 are series connected at opposite ends of a potentiometer 126 with one resistor 124 being connected to ground and the other resistor 125 being connected to the output P of the power block 30. Another resistor 127 is connected between the positive input of the comparator amplifier 121 and the connection between the power line resistor 125 and the potentiometer 126. The resistors 124 and 125 are selected to provide not less than 0.3 volts at the positive input of the comparator amplifier 121. This positive input preferably can range from approximately 0.3 to 13 volts, depending on the setting of the potentiometer 126. This determines the turn-off time of the comparator amplifier 121 which shuts off when its negative input ranges above the positive input set by the potentiometer 126. A resistor 128 connected between the positive input of the comparator amplifier 121 and its output T provides a hysteresis loop in the circuit.

Figure 8:
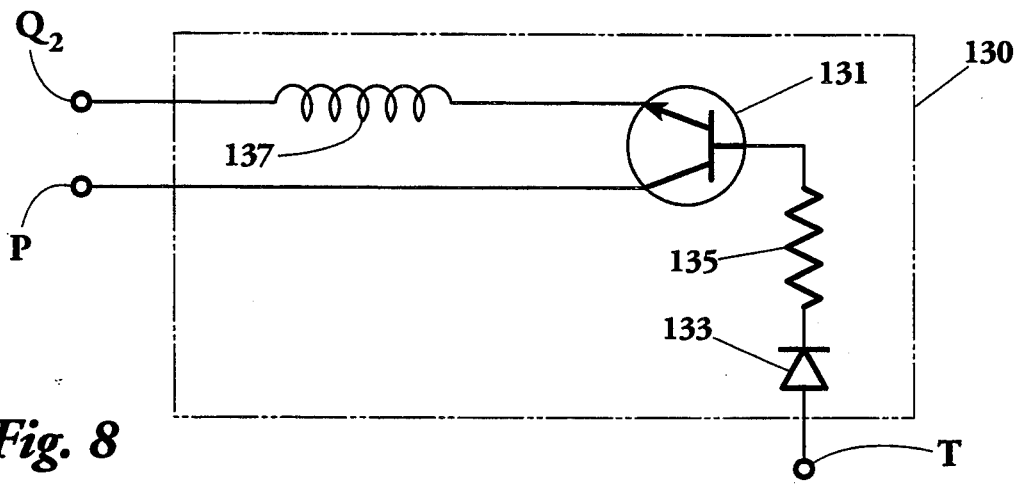
FIG. 8 is a schematic diagram of a typical switch block of the protection device DC components of FIG. 1.

As shown in FIG. 8, the switch block 130 includes a transistor 131 having its base connected to the output T of the timer block 110 through a diode 133 and a resistor 135. Since the output T of the timer block 110 is normally high, the transistor 131 is normally on. The diode 133 is provided to help accommodate the need for a proper voltage drop for the operation of the coil 137 which is connected through the transistor 131 to the output P of the power block 30 and the second contact point Q2 of the trigger block 90. Thus, when the control output C is applied to the trigger block 90, the second contact point Q2 of the trigger block is grounded and, since the transistor 131 in the switch block 130 is normally on, the coil 137 will be energized for as long as the control signal C persists and the output T of the comparator amplifier 121 remains high. As shown in FIG. 2, the energization of the coil 137 causes the switches 21 and 25 to close simultaneously, closing of the first switch 21 causing the fuse 17 to blow and interrupting power to the machine circuits 15, and closing of the second switch 25 causing the alarm 23 to be activated. The ramping action of the integrating amplifier 111 causes the output T of the comparator amplifier 121 to switch low or off. The transistor 131 turns off when the output T is low and the coil 137 releases the switches 21 and 25 to their normally open condition, turning off this alarm.

In the preferred embodiment, the circuit components will be as set forth in Table I below.

TABLE I

| # | TYPE | ID | # | TYPE | ID |
|---|---|---|---|---|---|
| 41 | Resistor | 2KΩ | 63 | Potentiometer | 5K |
| 55 | Resistor | 25KΩ | 126 | Potentiometer | 100K |
| 56 | Resistor | 100KΩ | 33 | Capacitor | 2200/25v |
| 65 | Resistor | 5KΩ | 37 | Capacitor | 1μ |
| 66 | Resistor | 100KΩ | 116 | Capacitor | 10μ |
| 68 | Resistor | 2KΩ | 39 | Diodes (LED) | |
| 73 | Resistor | 100KΩ | 67 | Diodes (LED) | |
| 75 | Resistor | 100KΩ | 85 | Diodes (LED) | |
| 77 | Resistor | 100KΩ | 117 | Diodes | 1N4001 |
| 79 | Resistor | 25KΩ | 133 | Diodes | 1N4001 |
| 83 | Resistor | 2KΩ | 51 | Amplifier | LM324N |
| 93 | Resistor | 20KΩ | 71 | Amplifier | LM324N |
| 97 | Resistor | 5KΩ | 111 | Amplifier | LM324N |
| 112 | Resistor | 1KΩ | 121 | Amplifier | LM324N |
| 113 | Resistor | 100KΩ | 91 | Transistor | NPN |
| 114 | Resistor | 10MΩ | 97 | Transistor | NPN |
| 115 | Resistor | 100KΩ | 131 | Transistor | NPN |
| 123 | Resistor | 100KΩ | 35 | Regulator | (ECG)968 |
| 124 | Resistor | 300Ω | 19,31 | Transformer | 15-18 Volts |
| 125 | Resistor | 15KΩ | 21,25,137 | Switch | 12V relay |
| 127 | Resistor | 10KΩ | 53 | Sensor | |
| 128 | Resistor | 10MΩ | 54 | Sensor | |
| 135 | Resistor | 5KΩ | | | |

In operation, the sensors are mounted at the selected points of entry to the vending machine and the anti-salting device is connected between the male and female connectors on the vending machine door and housing. The sensitive of the sensor block or blocks 50 is set by adjustment of their respective sensor potentiometers 63 as hereinbefore described. The alarm time is selected by setting the potentiometer 126 in the timer block 110. When any sensor is activated by the potentiometer of a selected foreign substance, the sensor block 50 emits a signal S that is received by the control block 70. When the foreign substance clears the sensor, the sensor block 50 will turn off but the control block 70 will remain latched on due to the latching resistor 75 until power P to the control block 70 is disconnected. The control block 70 in turn emits a signal C to the trigger block 90 which generates the negative output of the integrator 111 of the timer block 110 and also grounds one side of the induction coil 137 in the switch block 130. The timer block 110 output T is normally high and completes the circuit of the induction coil 137. The integrator 111 ramps sufficiently to turn off the comparator 121 and therefore disconnect the induction coil 137. The energization of the induction coil 137 simultaneously closes the alarm switch 25 and the interrupt switch 21 which causes the fuse 17 to blow, shutting off all power to the machine circuits 15.

Thus, it is apparent that there has been provided, in accordance with the invention, an anti-salting vending machine power interrupt that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. For use with a machine having a cabinet and machine electrical circuits contained therein connected to an AC power source and having at least one possible point for penetration through the cabinet of foreign substances into contact with the machine electrical circuits to cause their operation in violation of machine protocol, a protection device comprising:

an interrupt for series connection between the AC power source and the machine electrical circuits;

a DC power source;

at least one sensor means connected to said DC power source and disposed proximate at least one of the points of penetration for detecting the penetration of at least one of the foreign substances therein and for generating an electrical control signal in response to detection of penetration of at least one of the foreign substances, said sensor means generating said control signal continuously after detection of penetration of at least one of the foreign substances; and means responsive to said control signal for operating said interrupt to disconnect the machine circuits from the AC power source.

2. A protection device according to claim 1 further comprising:

an alarm connected to the AC power source on a power side of said interrupt; and means connected in series with said alarm for normally deactivating said alarm and for activating said alarm in response to said control signal.

3. A protection device according to claim 2 further comprising:

means responsive to said control signal for generating a timing signal commencing substantially simultaneously with said control signal and discontinuing after a preselected time; and means responsive to discontinuance of said timing signal for deactivating said alarm.

4. For use with a machine having a cabinet and machine electrical circuits contained therein connected to an AC power source and having at least one possible point of entry through the cabinet of foreign substances into contact with the machine electrical circuits to cause their operation in violation of machine protocol, a protection device comprising:

means series connected between the AC power source and the machine electrical circuits responsive to an overload of the AC power source to interrupt power to the machine circuits;

switching means connected in parallel with the machine circuits on a load side of said interrupt means in normally open condition for short-circuiting said AC power source and said interrupt means when said switching means is in a closed condition;

a DC power source;

first voltage divider means connected between said DC power source and said negative comparator input having at least one sensor electrically connected therein and disposed proximate at least one of the points of entry for becoming electrically conductive upon penetration of at least one of the foreign substances into contact therewith;

second voltage divider means connected between said DC power source and said positive comparator input having a variable resistance for setting the resistance point at which said comparator generates a sensor signal at said output;

means having a positive input connected through said second voltage divider means to said DC power source and a negative input connected through said first voltage divider means to said DC power source for comparing said inputs and for generating an electrical sensor signal at an output thereof when said positive input exceeds said negative input; and means connected to said comparator means output and responsive to said sensor signal for switching said normally open switching means to said closed condition to overload said interrupt means to disconnect the machine circuits from the AC power source.

5. A protection device according to claim 4, said switching means further comprising a control amplifier connected to said comparator means output at a positive input thereof and to said AC power source through a third voltage divider at a negative input thereof and having an output for providing a control signal when said comparator means output exceeds said amplifier negative input.

6. A protection device according to claim 5 further comprising feedback means connected between said amplifier output and positive input for latching said amplifier to generate said control signal continuously after generation of said sensor signal.

7. A protection device according to claim 6 further comprising means connected to said third voltage divider means for manually interrupting operation of said amplifier.

8. A protection device according to claim 6 further comprising:

an alarm connected to the AC power source on a power side of said interrupt means;

switching means connected in series with said alarm for activating and deactivating said alarm; and operating means connected in series with said DC power source for causing said alarm switching means to activate said alarm in response to said control signal.

9. A protection device according to claim 8, said operating means comprising a transistor which becomes conductive upon application of said control signal to a base thereof.

10. A protection device according to claim 8 further comprising integrator means having a positive input connected through a fourth voltage divider to said DC power source and a negative input connected through a fifth voltage divider to said DC power source and said control amplifier output and having an output for generating a ramping voltage commencing substantially simultaneously with said control signal.

11. A protection device according to claim 10 further comprising a second comparator means having a negative input connected to said integrator output, a positive input connected through a variable voltage divider to said DC power source and an output for providing a timing signal commencing substantially simultaneously with said control signal and terminating after generation of said ramping voltage for a time period established by said variable voltage divider.

12. A protection device according to claim 11, said operating means comprising a transistor having a base connected to said second comparator means output for deactivating said alarm upon cessation of said timing signal.

* * * * *